United States Patent [19]

Robertson et al.

[11] 4,070,571

[45] Jan. 24, 1978

[54] MODULAR BLOCK FLUORESCENT LAMP SUSPENSION SYSTEM

[75] Inventors: Ross E. Robertson; Donald L. Tomie, both of Calgary, Canada

[73] Assignee: Penguin Marketing Ltd., British Columbia, Canada

[21] Appl. No.: 682,141

[22] Filed: Apr. 30, 1976

[30] Foreign Application Priority Data

May 6, 1975 United Kingdom ..... 18942/75

[51] Int. Cl.[2] ..... H05B 33/02

[52] U.S. Cl. ..... 362/217; 339/52 R

[58] Field of Search ..... 240/51.11, 73 R, 81 R; 339/52 R

[56] References Cited

U.S. PATENT DOCUMENTS

| | | | |
|---|---|---|---|
| 2,503,876 | 4/1950 | Krauss | 240/51.11 R |
| 2,532,023 | 11/1950 | Guth, Jr. | 240/51.11 R |
| 3,524,053 | 8/1970 | Johnson | 240/51.11 R |

*Primary Examiner*—Richard A. Wintercorn

*Attorney, Agent, or Firm*—Stanley G. Ade

[57] ABSTRACT

Utilization of solid state ballasts enables the lamp suspension system to comprise a pair of end blocks carrying fluorescent lamp holders with the end blocks being secured to a supporting surface or having a relatively lightweight member extending between the end blocks to hold them in the desired spaced relationship. The end blocks may be designed for one or more parallel lamp tubes and may be secured together in side by side relationship with or without spaces. The solid state ballast may be situated remotely from the system or may be contained within the system in part or in whole.

9 Claims, 14 Drawing Figures

FIG. 1
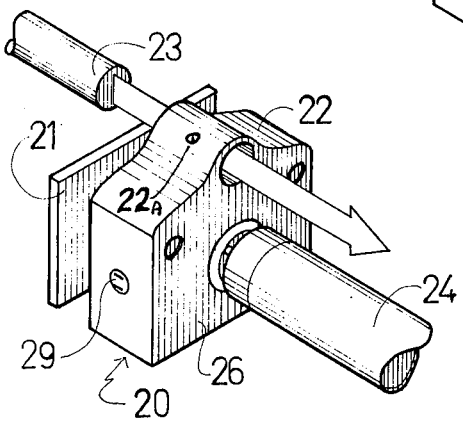
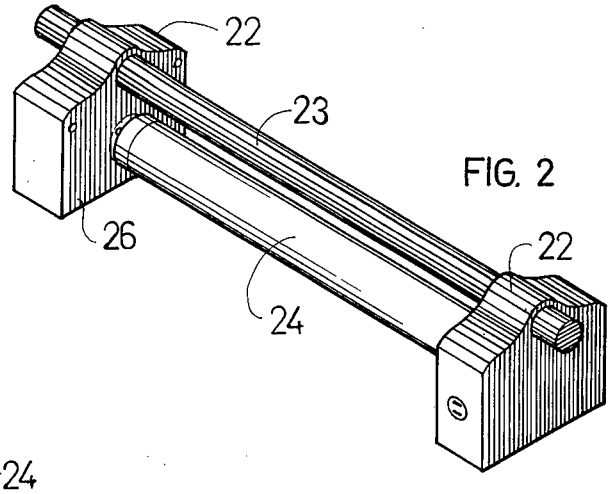
FIG. 2
FIG. 3
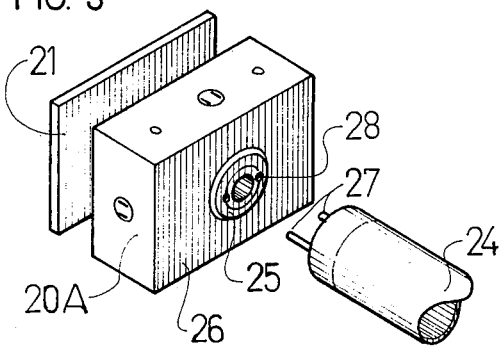
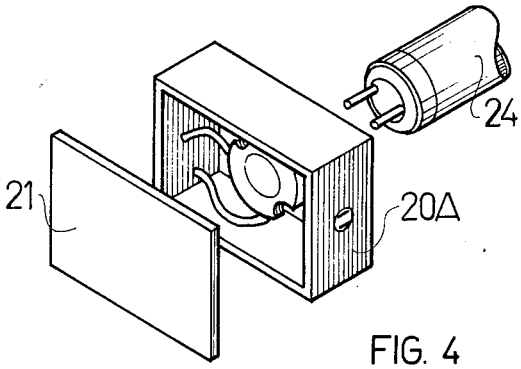
FIG. 4
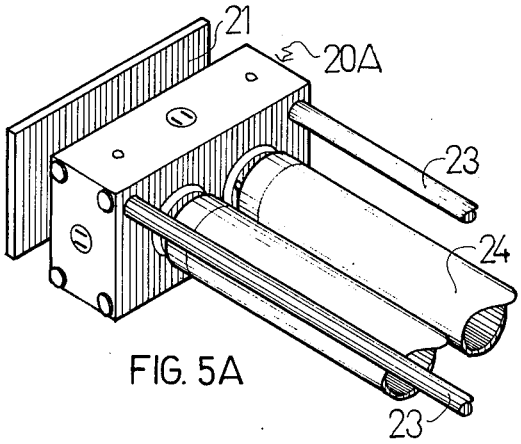
FIG. 5A
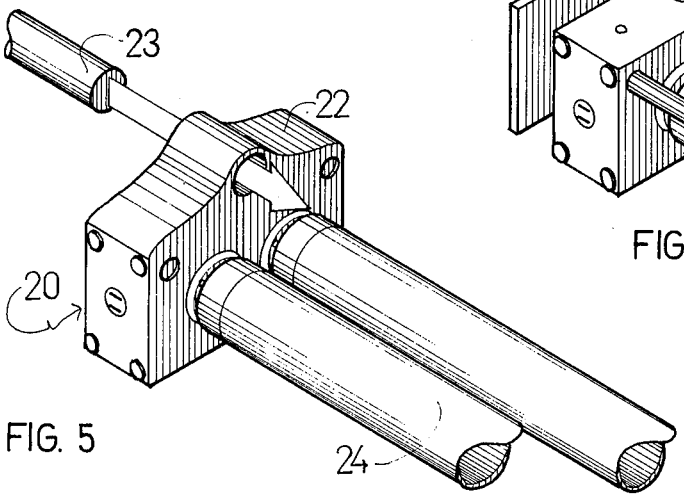
FIG. 5

33
20A
25

34
20B
32
31

34
20C 34
20D
20C
23

24
20C
37

20F 36
35
35
30
20E
120V
60HZ

MODULAR BLOCK FLUORESCENT LAMP SUSPENSION SYSTEM

BACKGROUND OF THE INVENTION

This invention relates to new and useful improvements in systems for the suspension of fluorescent lamp tubes.

Conventionally, fluorescent lamp tube suspension devices comprise a relatively heavy metal strip or casing which is mounted to a supporting surface and includes tube holders at either end thereof into which the fluorescent tubes may be engaged. The construction of such devices is relatively robust because the conventional ballast is contained therein and is relatively heavy. This form of construction is therefore severely limiting inasmuch as it is difficult to construct side by side arrangements holding a plurality of fluorescent tubes or end to end arrangements and the like.

SUMMARY OF THE INVENTION

The present invention overcomes all of these disadvantages because of the use of a solid state ballast which is extremely lightweight in construction and can be incorporated within the modular blocks making up the system, or alternatively, can be situated remotely therefrom depending upon design parameters. It should be understood that the particular construction of the solid state ballast may take many forms and does not form a part of this invention.

The use of these solid state ballasts rather than the usual ballasts enables the system to comprise end pieces bearing one or more tube holders compatible with the ends of fluorescent lamp tubes. The longitudinal position of the opposed end pieces may be achieved either through the end pieces being mounted on rods of suitable lengths or to side pieces which can form a frame on which to suspend a diffuser or upon which to mount a reflector of the conventional type. Alternatively, the end pieces may be mounted directly to a wall or to a suitable supporting structure since the necessity of a metal strip paralleling the fluorescent lamp tubes is obviated.

As mentioned previously, the modular end blocks may contain all or part or none of the controlling solid state ballast.

Another advantage is the fact that the modular blocks may be of such a shape and dimension as to provide for multiple units as will hereinafter be described. Furthermore, modular blocks mounting single fluorescent lamp holders may be joined to other similar modular blocks with or without spacers, in side by side relationship, to achieve the desired separation and spacing of individual fluorescent lamp tubes.

Another advantage is the fact that the modular end blocks, which may be cast in one piece and from plastic, can be designed to accommodate, for example, four fluorescent tubes in side by side relationship and may be joined to side pieces to form what is essentially a frame which may be set in the ceiling and serve to suspend a diffuser.

As mentioned previously, the conventional fluorescent lamp suspension system consists of a metal channel running the length of the tube or tubes, with the weight and dimensions of the channel being determined in part by the necessity of mounting a relatively heavy ballast therein and at the same time dissipating heat from said ballast. Such suspensions are expensive to manufacture and to transport, and cannot be joined conveniently in multiple units.

With the foregoing objects in view, and other such objects and advantages as will become apparent to those skilled in the art to which this invention relates as this specification proceeds, my invention consists essentially in the arrangement and construction of parts all as hereinafter more particularly described, reference being had to the accompanying drawings in which:

DESCRIPTION OF THE DRAWINGS

FIG. 1 is a fragmentary isometric partially exploded view of one design of a modular block showing one method of mounting same.

FIG. 2 is an isometric view of a completed system utilizing the structure of FIG. 1.

FIG. 3 shows a view similar to FIG. 1, but with an alternative configuration.

FIG. 4 is substantially a rear isometric view of FIG. 3.

FIG. 5 is a fragmentary partially exploded isometric view showing the structure of FIG. 1 adapted for use with two fluorescent tubes and two supporting members.

FIG. 5A is a fragmentary partially exploded isometric view showing the structure of FIG. 3 adapted for use with two fluorescent tubes and two supporting members.

In the drawings like characters of reference indicate corresponding parts in the different figures.

DETAILED DESCRIPTION

Figures 6, 7, 8, 9, 10, 11, 12, 13:
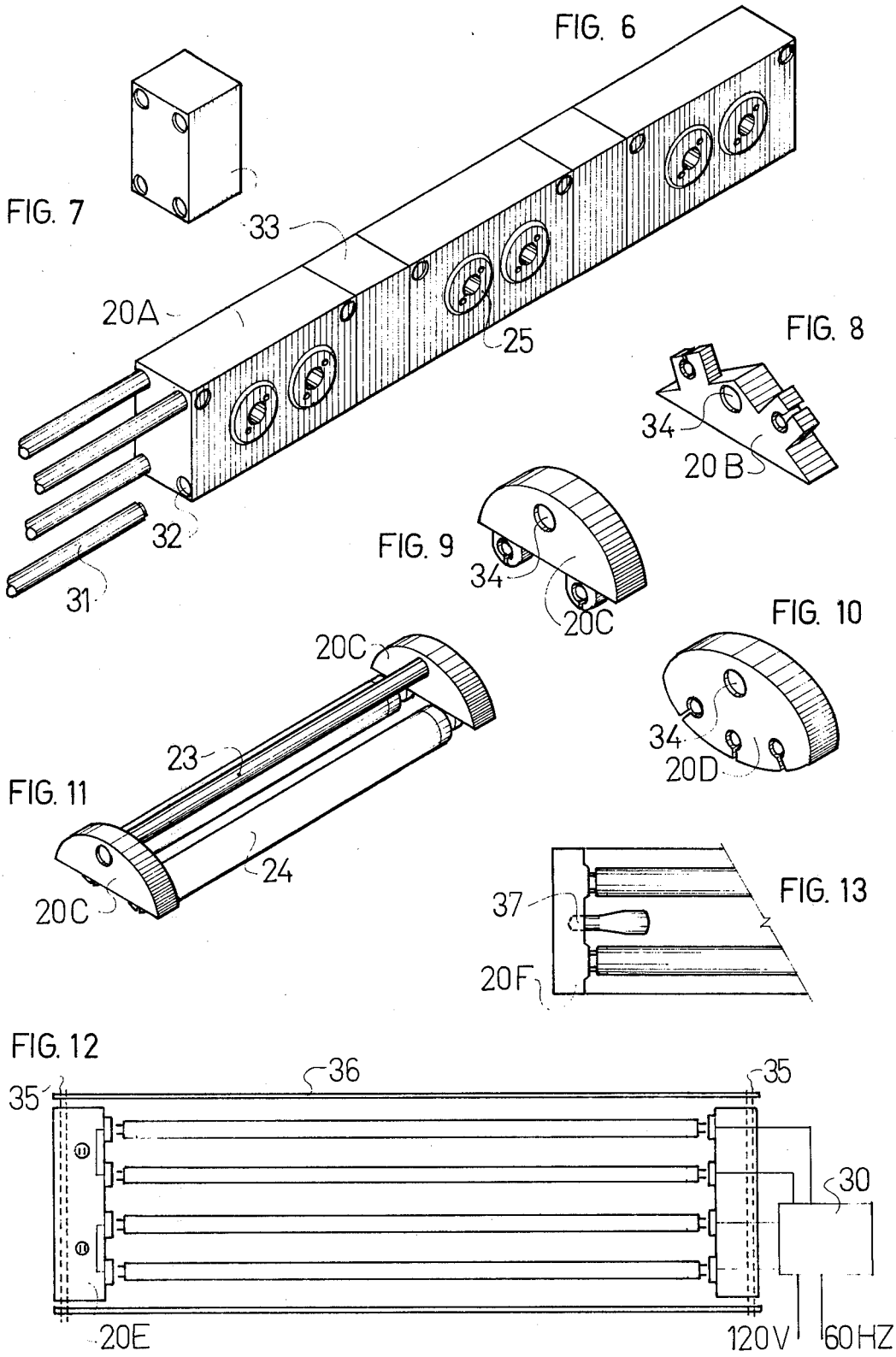
FIG. 6 is an isometric view showing one method of joining adjacent modular blocks in side by side spaced relationship.
FIG. 7 is an isometric view of one of the spaces used in FIG. 6.
FIG. 8 is an isometric view of an alternative design of the modular block.
FIG. 9 is an alternative design of a modular block.
FIG. 10 is an isometric view of an alternative design of a modular block.
FIG. 11 is an isometric view of an assembly utilizing the embodiment illustrated in FIG. 9.
FIG. 12 is an underside view showing one method of joining connecting sides to end blocks.
FIG. 13 is an underside view showing an alternative method of construction.

This invention relates to a new method of holding and suspending fluorescent lamp tubes and provides for the incorporation of all or part or none of the solid state ballast in the opposed modular blocks which form the end pieces and which are the main structural members of the systems. Provision for wiring to connect pairs of fluorescent tubes and provision for plug-in power supplied from an internal ballast or form an external ballast may be provided in the end pieces and these modular end pieces can, of course, be of various dimensions to accommodate the tube holders and can be provided with means for mounting longitudinal members either above or the sides as frame pieces which may be used for mounting a reflector as will become apparent.

Proceeding therefore to describe the invention in detail, FIG. 1 shows a modular block collectively designated 20 which may be formed of plastic or which may be formed as a hollow casing with a detachable back panel 21.

A cylindrical boss 22 is formed on the upper surface of the block 20 and this boss is apertured to receive a longitudinally extending supporting rod 23 so that the block 20 may be clamped in position along the length of the rod 23 by any conventional means such as a clamp screw 22A.

A pair of such blocks is shown secured to the rod 23 in FIG. 2 with the blocks being positioned to receive a conventional fluorescent lamp tube 24 therebetween. In this connection, a tube receptable 25 (see FIG. 3) is formed in the one face 26 of the block so that the pins 27 of the tube end may engage within drillings or apertures 28 in the tube holder 25. By providing the desired spacing as shown in FIG. 2, the tube may be suspended between the two opposed modular blocks 20 as clearly indicated. The tubes are engaged within one tube holder 25 whereupon the opposite block can be slid along the rod 23 until the other end of the tube engages within the tube holder of the opposite block and the block is then clamped into position. Alternatively, of course, conventional type tube holders can be used.

External power may be conveyed to the modular block 20 by means of a plug-in receptacle 29 provided in the side of the block and the necessary electrical connections may be made to the fluorescent tube ends in the conventional manner. In this regard, all or part or none of a solid state ballast (shown schematically by reference character 30 in FIG. 12) may be provided within the modular block 20. Alternatively, all or part or none of this solid state ballast 30 may be situated remotely from the block and connected thereto by conventional wiring shown schematically in FIG. 12.

FIGS. 3 and 4 show an alternative method of construction of the modular block 20A which is particularly adapted for use when mounted against a side wall or other form of supporting structure thus eliminating the necessity for the support rods 23. Inasmuch as the structure of the embodiment in FIG. 3 is similar to that shown in FIGS. 1 and 2, similar reference characters have been given.

FIGS. 5 and 5A show a modification of FIGS. 1 and 3 respectively inasmuch as the blocks have been redesigned to carry a pair of fluroescent tubes 24 in side by side relationship. It will be noted that the modification to the structure shown in FIG. 3, may incorporate a pair of spaced and parallel rods 23 extending between opposing blocks in a manner similar to that hereinbefore described.

If desired, the individual blocks may be mounted in side by side relationship as shown in FIG. 6 and in this regard, tie rods 31 may engage through apertures 32 so that these tie rods connect a plurality of modular blocks 20A together with or without apertured rectangular spacers 33 being provided between individual modular blocks 20A as clearly illustrated. Once again rods 23 (not illustrated in FIG. 6) may be provided to mount the blocks in spaced apart relationship so that fluorescent lamp tubes 24 may be mounted therebetween in a manner similar to that hereinabove described.

FIGS. 8, 9 and 10 show isometric views of other designs of modular blocks 20B, 20C and 20D respectively with the configuration of these blocks adapted to suit various forms of mounting. One again mounting rods 23 (not illustrated) may extend between opposing modular blocks engaging through apertures 34 formed through the modular block in a manner similar to that described for FIG. 1.

FIG. 11 shows an isometric view of a completed assembly utilizing the particular design of modular block 20C illustrated in FIG. 9.

FIG. 12 shows an underside view of a multiple modular block 20E constructed in a manner similar to that hereinbefore described, but including transverse tie bars 35 which may be used to secure connecting side panels or members 36 one upon each side of the blocks. These panels may be utilized to support a reflector or conventional diffusers (not illustrated). In this regard, the configurations shown in FIGS. 8, 9 and 10 are particularly adapted to support reflectors or the like.

In FIG 12, the ballast 30 is shown connected schematically and also is shown connected schematically to a source of electrical energy.

FIG. 13 shows an alternative embodiment in which the modular blocks 20F not only include fluorescent tube end receptacles 25, but also screw-in type receptacles 37. These screw sockets 37 may accommodate scres-type lamps such as mercury vapor or high pressure sodium lamps or the like. Alternatively, they may be utilized to receive low voltage lamps either as an adjunct to the fluorescent tubes or wired to an emergency supply (not illustrated).

It should be noted that any of the fluorescent tube sockets 25 may be replaced with a screw-type socket if desired and that conventional fluorescent tube sockets can be used.

As mentioned previously, it will be realized that the modular end pieces or blocks 23, etc., may be formed with provision of one, two, three or four lamp holders or these may be built up from individual modular blocks, as for example, as illustrated in FIG. 6.

Furthermore, the longitudinal position of opposed end pieces or blocks can be established by securing the end pieces or blocks to one or more rods 23 of suitable length by conventional means, or alternatively, the end pieces or blocks may be attached to side peices to form a frame to which a reflector may be attached. This reflector may be lightweight metal or plastic as weight and heat are no longer of significance. As mentioned previously, where desirable, the blocks may be attached directly to a wall or other structure for example, the wall in an indirect lighting treatment such as a wall supporting a wash basin or the like.

It will be appreciated that one of the major departures from the conventional fluorescent lighting fixture is the fact that part or all of the ballast may be incorporated into the modular blocks with the opposing end pieces serving merely to mount the tube holders and establish electrical connections therebetween. Furthermore, a dimming control and/or a low voltage relay control may also be included in the ballast either in the end block or in a remote position therefrom.

The modular blocks or end pieces provide the main structural feature in the present device with the longitudinal members or rods 23 being of variable length and of any convenient cross section thus giving an obvious advantage in terms of cost of contruction and in shipping costs as well as in installation costs since the attachment of the power to the unit is through a plug-in receptacle built into the end pieces or wired directly into the end pieces.

The modular block design is adaptable to all configurations of fluorescent lamps and bases and there are no restrictions with respect to A.C. or D.C. voltages or to frequencies in normal use.

The inclusion of a solid state ballast such as that illustrated schematically by reference character 30 does not depend on any particular circuitry, voltage, or frequency but is rather a question of positioning and suspension and this becomes superfluous where the ballast is centralized and external to the unit. In such cases the modular blocks can be modified with respect to thickness without altering the basic concept as it is obvious that the omission of the ballast from the modular block does not alter the suspension features of this design.

Inasmuch as the modular blocks may be sealed, there is no restriction in use with regard to the environment either indoors or outdoors and restrictions with regard to fire, weather or explosive atmospheres are limited to those inherent in the tube holders and not to the modular block construction.

Finally and summarizing, the advantages may be listed as follows:

A fluorescent lamp suspension system in the form of two opposed modular blocks mounting one or more lamp holders separated by longitudinal members. The end pieces containing whole or part or none of a solid state ballast being joined to the longitudinal members to adjust separation of the end pieces to the dimension necessary to accommodate the requisite fluorescent lamp tubes.

A fluorescent lamp suspension system in which the longitudinal members separating the end pieces may be superimposed above the end blocks or may serve to form the sides of a frame or may be part of the reflector system.

A fluorescent lamp suspension with a plug-in receptacle feature or knock-out for bringing power into the unit from a remote ballast so that one end piece acts as its own junction box, or to supply a solid state ballast housed in the end piece.

A fluorescent lamp suspension system having superimposed provision for mounting a reflector and/or a light diffuser.

A fluorescent lamp suspension system with provisions for joining to other modular blocks with or without spacers to adjust the spacing of parallel lamps in transverse juxtaposition.

A fluorescent lamp suspension system in which the end blocks are so shaped as to accommodate diffusers or reflectors.

A fluorescent lamp suspension system containing, between the opposed modular blocks, the components of a ballast and/or a dimming control.

A fluorescent lamp suspension system containing in the modular blocks and in the suspension system supplementary circuitry and parts to accommodate emergency fluorescent lighting or emergency conventional lighting.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What we claim as our invention:

1. A fluorescent lamp suspension system comprising in combination a pair of end blocks, fluorescent lamp holder in each of said end blocks and means to support and maintain said end blocks in the desired spaced relationship to receive and operatively support a conventional fluorescent lamp tube, said means including said end blocks being apertured parallel to the longitudinal axis of said system and above said lamp holders and a rod slidably engaging within said apertures and clamp means co-operating between said rod and said end blocks to detachably secure said end blocks on said rod in the desired spaced relationship.

2. The system according to claim 1 which includes a plurality of end blocks in side by side relationship and means to maintain said end blocks in the said side by side relationship.

3. The system according to claim 2 in which said last mentioned means includes said end blocks being apertured transversely and at least one rod extending through said transversely apertured blocks and means to detachably secure said blocks to said rod.

4. The system according to claim 3 which includes spaces between adjacent end blocks, said spaces also engaging said rod.

5. The system according to claim 1 in which said fluorescent lamp holders including mounting plates secured to the inner vertical face of said end block and a pair of space pin sockets formed in said face to receive, in an operative electrical connection, the pins of a conventional fluorescent lamp tube, said blocks sliding lengthwise on said rod to engage said pins prior to the operation of said clamps means.

6. The system according to claim 2 in which said fluorescent lamp holders including mounting plates secured to the inner vertical face of said end block and a pair of spaced pin sockets formed in said face to receive, in a operative electrical connection, the pins of a conventional fluorescent lamp tube, said blocks sliding lengthwise on said rod to engage said pins prior to the operation of said clamp means.

7. The system according to claim 5 which includes a screw threadably engageable lamp socket on said inner face between said fluorescent lamp sockets.

8. A system according to claim 1 which includes the attachment of said modular blocks directly to a supporting surface.

9. A system as described in claim 2 incorporating a low voltage relay control in said modular block.

* * * * *